US005542675A

United States Patent [19]

Micciche et al.

[11] Patent Number: 5,542,675

[45] Date of Patent: Aug. 6, 1996

[54] ADAPTOR FOR GOLF PUTTER AND GOLF PUTTER FITTED THEREWITH

[75] Inventors: Gino Micciche; Giovanni Martorana; Sergio Martorana, all of Jamestown, N.Y.

[73] Assignee: Italgom U.S.A., Jamestown, N.Y.

[21] Appl. No.: 374,306

[22] Filed: Jan. 18, 1995

[51] Int. Cl.[6] ..... A63B 69/36

[52] U.S. Cl. ..... 473/329; 473/340; 473/342

[58] Field of Search ..... 273/78, 167 R, 273/167 J, 173, DIG. 3, DIG. 9, DIG. 10, 167 H, 77 R, 79, 186.2, 187.4, 193 R, 194 R, 194 A, 162 R

[56] References Cited

U.S. PATENT DOCUMENTS

| | | | |
|---|---|---|---|
| 2,495,679 | 1/1950 | Abrecht | 273/194 A |
| 3,211,455 | 9/1962 | Hyden . | |
| 3,401,941 | 9/1968 | Hesidence | 273/78 |
| 3,489,415 | 1/1970 | Smith | 273/186.2 |
| 4,156,526 | 5/1979 | Huggins et al. . | |
| 4,323,246 | 4/1982 | Nehrbas | 273/186.2 |
| 4,422,638 | 12/1983 | Tucker . | |
| 4,575,090 | 3/1986 | Heseltine | 273/187.4 |
| 5,083,778 | 6/1992 | Douglass . | |

FOREIGN PATENT DOCUMENTS

| | | | |
|---|---|---|---|
| 547946 | 9/1942 | United Kingdom | 273/162 R |

OTHER PUBLICATIONS

Advertisement from Links magazine for "The Odyssey Putter".

*Primary Examiner*—Sebastiano Passaniti
*Attorney, Agent, or Firm*—Larson & Taylor

[57] ABSTRACT

A golf putter head adaptor for providing a putter head with an elastomeric striking surface is provided. More particularly, the adaptor includes a central portion adapted to cover a substantial portion of the striking surface of a putter head, an upper lip portion adapted to engage the top surface of a putter head and a bottom lip portion adapted to engage the bottom surface of a putter head. The adaptor also includes an elastomeric portion associated with the central portion of the attachment layer such that it covers a sufficient portion of the striking surface of the putter head to allow the striking of a golf ball exclusively with the elastomeric portion of the striking surface. Also provided is a putter including the putter head adaptor and a snap-on putter head adaptor for providing an elastomeric striking surface to a putter head. The putter head adaptor of the present invention has the advantage that it can be employed to adapt an existing putter to provide it with an elastomeric striking surface and it can be removed and exchanged in order to adapt the putter to the prevailing playing conditions.

19 Claims, 4 Drawing Sheets

FIG. 1
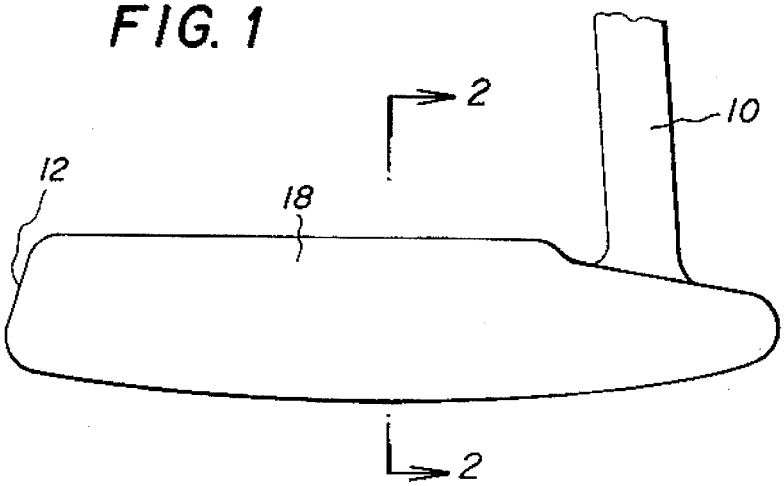
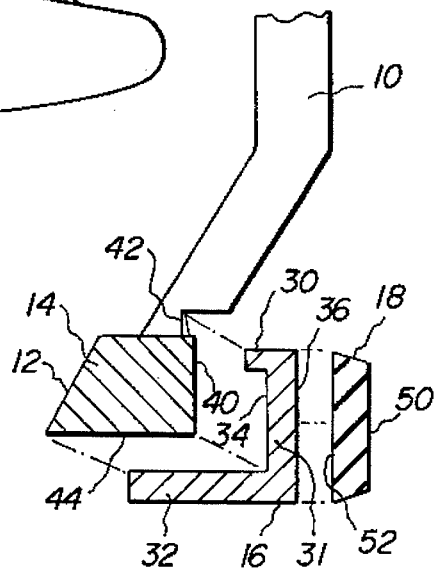
FIG. 2
FIG. 3
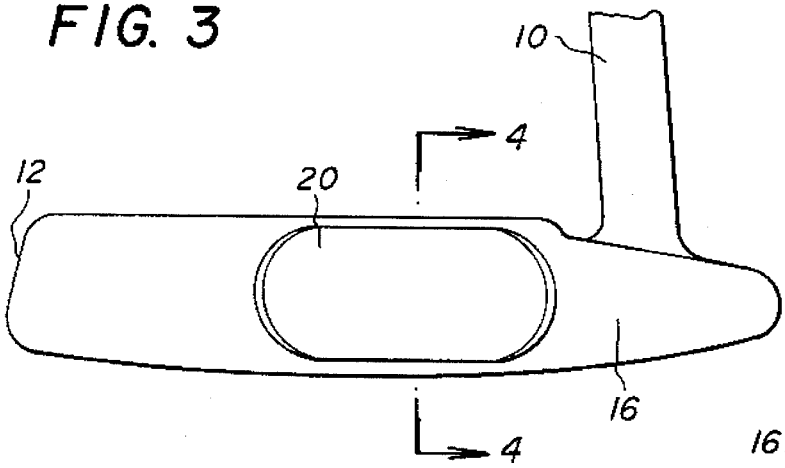
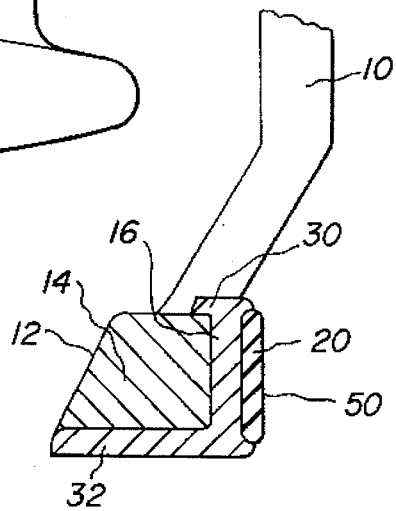
FIG. 4

ADAPTOR FOR GOLF PUTTER AND GOLF PUTTER FITTED THEREWITH

FIELD OF THE INVENTION

The present invention relates to an adaptor for a golf putter and to a golf putter fitted with the adaptor. More particularly, the present invention provides an improved means for adapting a golf putter to provide an elastomeric striking surface to the putter head.

BACKGROUND OF THE INVENTION

The desire for a putter providing improved putting accuracy and control is well documented by the vast number of patents directed to golf putters. Several issued patents in this area disclose putters having striking faces which are made from a different, generally more resilient material than the body of the putter head itself which is typically made from a metal or other rigid material, such as graphite or a ceramic composite.

One of the earliest known putters having a striking face made from a resilient material is disclosed in U.S. Pat. No. 3,211,455. The resilient material is preferably rubber having a hardness between 65 and 85 durometers. The resilient striking face is said to provide the golfer with a greater sense of touch or feel during stroking of the ball.

U.S. Pat. No. 4,156,526 discloses a putter having a putter head which defines an elongate cavity in which a resilient block is disposed. The resilient block serves as the putter striking face. The block is shaped such that when a golf ball is struck, the rearwardly deformed area of the block assumes an elliptical shape which moves in a vertical direction relative to the golf ball. In this manner, it is said that the golf ball is not diverted from a path normal to the putter's striking surface by the deformation of the resilient material.

U.S. Pat. No. 4,422,638 discloses a golf putter having a soft face formed from an elastomer having a high resilience and a hardness greater than about 70 durometers. The high resilience of the elastomer is believed to cause the ball to rebound sharply without energy loss thereby increasing the distance of ball travel. This is said to permit the use of a shorter backswing to thereby increase the accuracy of the putting stroke.

U.S. Pat. No. 5,083,778 also discloses a golf putter having a resilient laminated striking face secured to a rigid putter head. The laminated striking face includes an outer layer of resilient material adapted for striking a golf ball and inner layer of resilient material which is secured to the club face undersurface as defined by the putter head body and which has a hardness less than that of the outer layer. The laminate is typically employed as an insert in a rigid putter head.

Thus, although a number of different putters exist which employ an elastomeric striking surface, none of these putters is adapted for removal or replacement of the elastomeric surface. Rather, the prior art devices only contemplate the production of putter heads including a built-in elastomeric striking surface.

Therefore, a need exists for improvements in putter heads whereby an existing rigid putter head can be converted to a putter head including an elastomeric striking surface. Further, there is a need for an adaptor for providing an elastomeric striking surface to putter heads, which adaptor may be easily removed for repair and/or replacement of the elastomeric striking surface.

SUMMARY OF THE INVENTION

It is a goal of the present invention to provide a putter head adaptor which can be employed to provide an elastomeric striking surface to a putter head.

This goal of the present invention is achieved by providing a structure which includes an elastomeric portion which serves as the striking surface of the putter head, and a means for affixing the elastomeric portion to a putter head, which means is adapted to fit with an existing putter head. In this manner, an existing putter may be adapted to provide it with an elastomeric striking surface.

In one embodiment of the present invention, there is provided an adaptor for adapting an existing golf putter to provide it with an elastomeric striking surface. The adaptor includes an attachment layer having a central portion adapted to cover a substantial portion of the striking surface of a putter head, an upper lip portion adapted to engage the top surface of the putter head and a lower lip portion adapted to engage the bottom surface of the putter head. The adaptor further includes an elastomeric portion affixed to the central portion of the attachment layer such that it covers a sufficient portion of the striking surface of the putter head to allow the striking of a golf ball exclusively with the elastomeric portion.

In a second embodiment of the present invention, there is provided a snap-on elastomeric putter face for adapting a rigid putter head to provide the putter head with an elastomeric striking surface. The snap-on putter face includes an upper lip portion adapted to releasably engage the top surface of the putter head and a lower lip portion adapted to releasably engage the bottom surface of the putter head.

The present invention also provides, in a third embodiment, a putter which is fitted with the golf putter head adaptors described above.

It is therefore an object of the present invention to provide an adaptor for converting an existing golf putter head to a putter head provided with an elastomeric striking surface.

It is a further object of the present invention to provide a releasably attachable adaptor for a golf putter head which provides an elastomeric striking surface to the putter head and which may be removed for repair and/or replacement.

It is a still further object of the present invention to provide an adaptor which may be fabricated separately from a golf putter head and later associated with the golf putter head such that the same golf putter can be employed either with or without an elastomeric striking face.

Other objects and advantages of the present invention will become apparent from the figures and detailed description which follow

BRIEF DESCRIPTION OF THE DRAWINGS

FIG. 1 is a side elevation of a putter in accordance with the present invention.

FIG. 2 is an exploded, cross-sectional view taken along lines 2—2 of FIG. 1.

FIG. 3 is a side elevation of a second embodiment of a putter in accordance with the present invention which employs an elastomeric insert.

FIG. 4 is a cross-sectional view along lines 4—4 of FIG. 3.

DESCRIPTION OF THE PREFERRED EMBODIMENTS

Figure 5:
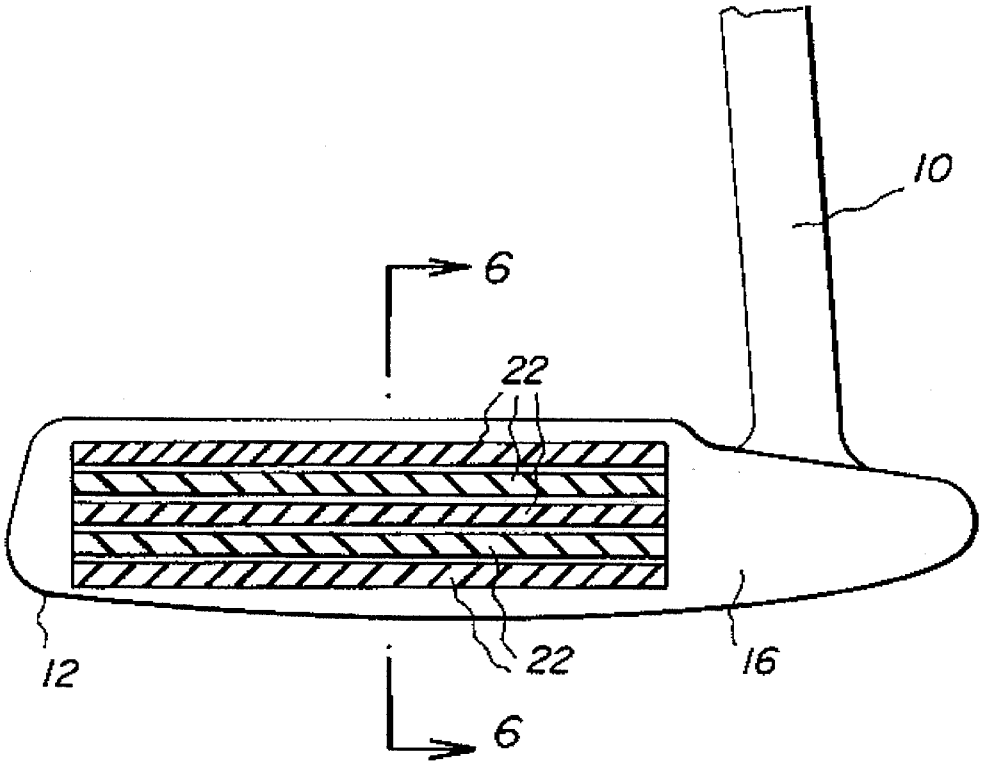
FIG. 5 is a side elevation of a third embodiment of a putter in accordance with the present invention employing elastomeric strips.

Referring now to the figures, like elements are represented by like numerals throughout the several views.

In FIG. 1 is shown a putter in accordance with the present invention including a shaft 10 and a putter head 12. Putter head 12 is fitted with an elastomeric layer 18 which, in this embodiment, covers the entire striking surface of putter head 12.

Referring now to FIG. 2, there is shown an exploded, cross-sectional view of the putter depicted in FIG. 1. The putter head 12 of this embodiment comprises a rigid head portion 14, an attachment layer 16 and an elastomeric layer 18.

Rigid head portion 14 is attached to shaft 10 by any conventional means and may also be formed as an integral element of shaft 10. Rigid head portion 14 includes a striking surface 40, a top surface 42 and a bottom surface 44. Surfaces 40, 42 and 44 are the same throughout the several figures and are not numbered in the remaining figures for the sake of clarity.

Attachment layer 16 comprises an upper lip portion 30 which is adapted for engagement with top surface 42 of rigid head portion 14. Attachment layer 16 also includes a central portion 31 which fits snugly over striking surface 40 of rigid head portion 14. Finally, attachment layer 16 includes a lower lip portion 32 adapted to engage bottom surface 44 of rigid head portion 14. When attachment layer 16 is attached to rigid head portion 14, the inner surface 34 is in contact with striking surface 40 of rigid head portion 14.

Attachment layer 16 may be affixed to rigid head portion 14 in any suitable manner such as by an adhesive, vulcanization in the case of attachment layer 16 comprising a rubber material, or by lamination.

In a more preferred embodiment of the present invention, attachment layer 16 comprises a semi-rigid material which is adapted to snap-fit with rigid head portion 14. More particularly, upper lip portion 30 and lower lip portion 32 are adapted to fit snugly about rigid head portion 14 so that attachment layer 16 can be releasably attached to rigid head portion 14 by engaging lower lip portion 32 with bottom surface 44 of rigid head portion 14 and deforming attachment layer 16 around the top edge of striking surface 40 to bring upper lip portion 30 into engagement with top surface 42 of rigid head portion 14. In this manner, attachment layer 16 is attached to rigid head portion 14 by frictional engagement therewith and thus may be easily removed and replaced, if desired.

Finally, elastomeric layer 18 as shown in FIG. 2 includes an elastomeric striking surface 50 and an elastomeric back surface 52. Elastomeric back surface 52 is adapted for engagement with outer surface 36 of attachment layer 16. Typically, elastomeric back surface 52 will be affixed to outer surface 36 of attachment layer 16 with an adhesive, by vulcanization, by lamination or any other suitable means. Surfaces 34,36 of attachment layer 16 are the same for FIGS. 3–8 and thus have not been labeled for the sake of clarity.

The embodiment of FIGS. 1–2 provides a convenient means for attaching an elastomeric striking surface to an existing putter head. The advantage of this is that the manufacturer need not alter his putter design or production process in any way since an existing putter can be converted to a putter with an elastomeric striking surface by employing the adaptor of the present invention. Thus, a manufacturer could offer the same putter with a rigid striking surface and with an elastomeric striking surface without having to substantially modify the putter head design.

Referring now to FIG. 3, there is shown a second embodiment of the present invention wherein the putter head 12 is equipped with an elastomeric insert 20 adapted to cover only a portion of the total striking surface 40 of putter head 12. More particularly, the putter shown in FIG. 3 includes shaft 10, putter head 12, attachment layer 16 and an elastomeric insert 20. As shown in FIG. 3, attachment layer 16 is adapted to cover the entire striking surface 40 of putter head 12. However, it is also possible to provide a smaller attachment layer 16 which covers only a portion of the striking surface 40 equal to or greater than the portion covered by elastomeric insert 20.

Referring now to FIG. 4, there is shown a cross-sectional view along lines 4—4 of FIG. 3. Again, attachment layer 16 is affixed to rigid head portion 14 by virtue of upper lip portion 30 engaging top surface 42 of rigid head portion 14 and lower lip portion 32 engaging bottom surface 44 of rigid head portion 14. However, in this embodiment, the elastomeric insert 20 is embedded into attachment layer 16 and is adapted to cover only a portion of the total striking surface 40 of rigid head portion 14. As shown in FIG. 4, elastomeric insert 20 may protrude slightly beyond the outer surface 36 of attachment layer 16 or, in an alternative embodiment (not shown), the elastomeric insert 20 may be embedded in attachment layer 16 such that the elastomeric striking surface 50 is flush with the outer surface 36 of attachment layer 16. This alternative embodiment would provide the putter with two distinct striking surfaces having different degrees of elasticity, when attachment layer 16 is made from material having a lesser degree of elasticity than the elastomeric insert 20. As a result, when putting, the player could strike the golf ball using elastomeric insert 20 for uphill and relatively flat putts, and could employ the toe or heel of the putter head 12 to strike the golf ball with the attachment layer 16 for downhill putts where less rebound of the golf ball would be desired.

Another advantage of the embodiment of FIGS. 3–4 is that it allows the total thickness of attachment layer 16 and elastomeric insert 20 to be reduced as compared with the embodiment of FIGS. 1–2 where two distinct layers are required. In this manner, a thinner putter head adaptor can be provided using the embodiment depicted in FIGS. 3–4.

Figure 6:
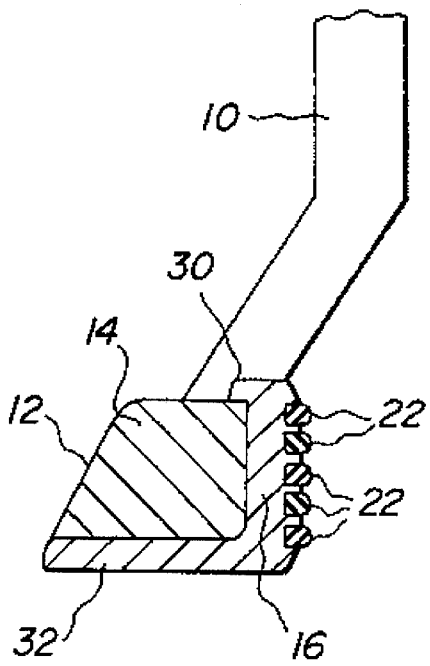
FIG. 6 is a cross-sectional view taken along lines 6—6 of FIG. 5.

Yet another embodiment of the present invention is shown in FIGS. 5–6 where all elements are the same as in the embodiment shown in FIGS. 1–2 except for the replacement of elastomeric layer 18 with a plurality of elastomeric strips 22. Elastomeric strips 22 may be affixed to attachment layer 16 in any manner specified above for attachment of elastomeric 18 layer to attachment layer 16. Employment of elastomeric strips 22 as the striking surface of putter head 12 provides the additional advantage of grooves in the elastomeric striking surface 50 which serve to minimize movement of the elastomeric striking surface 50 relative to the golf ball during contact therewith since these grooves will provide a better grip on the golf ball than would a smooth elastomeric striking surface 50. It is thought that such grooves will provide a more consistent contact between the elastomeric striking surface 50 and the golf ball.

Figure 7:
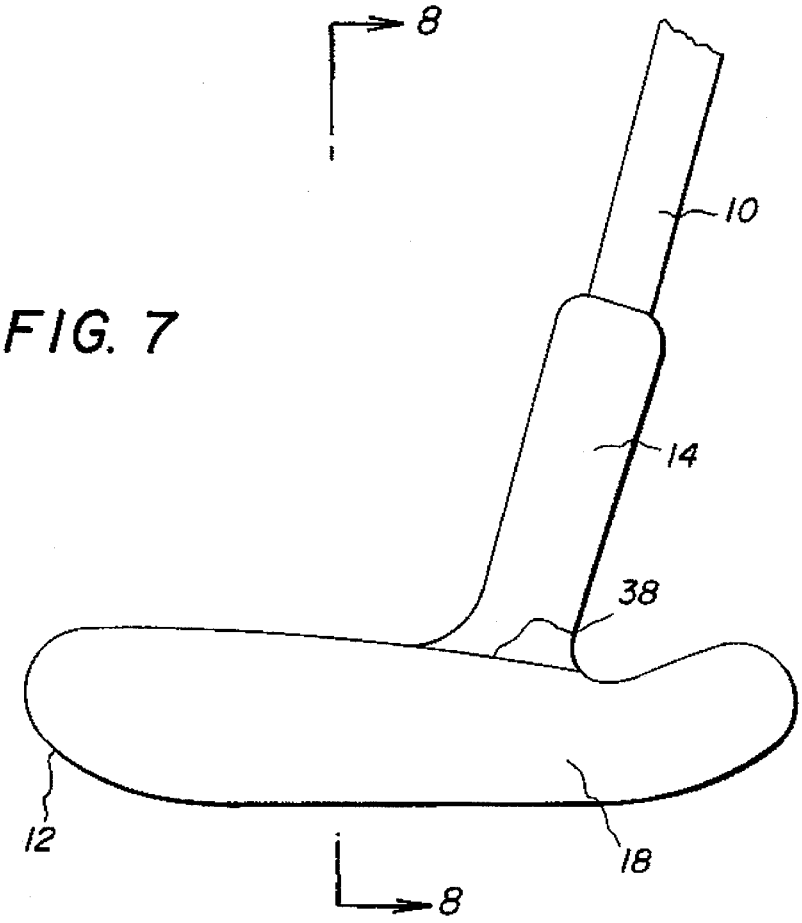
FIG. 7 is a side elevation of a putter in accordance with the present invention which is adapted for both right-handed and left-handed putters.

In addition, the use of elastomeric strips 22 reduces the total contact surface between elastomeric striking surface 50 and the golf ball as compared, for example, to either an elastomeric layer 18 or an elastomeric insert 20. In this manner, the amount of rebound produced by a given elastomer can be reduced since the contact area with that elastomer is reduced. This provides an additional means for customizing the characteristics of the elastomeric striking surface 50, Referring now FIGS. 7–8, there is depicted a further embodiment of the present invention wherein a putter is provided which can be employed by both left-handed and right-handed players. FIG. 7 shows a typical reversible putter, including a putter head 12 having an extended rigid head portion 14 which envelopes shaft 10 as shown. In order to fit attachment layer 16 over this type of putter head 12, attachment layer 16 may include an opening 38 which allows passage of the extended rigid head portion 14 therethrough.

Figure 8:
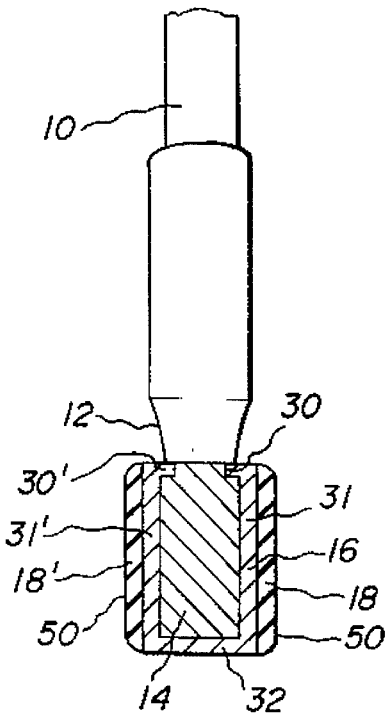
FIG. 8 is a cross-sectional view along lines 8—8 of FIG. 7.

Referring now to FIG. 8, there is shown a cross-sectional view along lines 8—8 of FIG. 7. From FIG. 8, it can be seen that attachment layer 16 envelopes rigid head portion 14. This embodiment differs from previous embodiments in that attachment layer 16 includes a second central portion 31' which covers the second striking surface 40 of this reversible putter. The second central portion 31' is attached to a second upper lip portion 30' adapted to engage the top surface of putter head 12 as shown in FIG. 8. Further, this embodiment requires two separate elastomeric layers 18 and 18', one for each striking surface 40 of the reversible putter.

In the alternative, elastomeric layers 18 and 18' may be formed by a single, integral elastomeric piece (not shown) which would connect under the bottom surface 44 of putter head 12. The embodiment of FIGS. 7–8 is advantageous since the elastomeric striking surfaces 50 and 50' can be easily removed or replaced, when desired.

Figure 9:
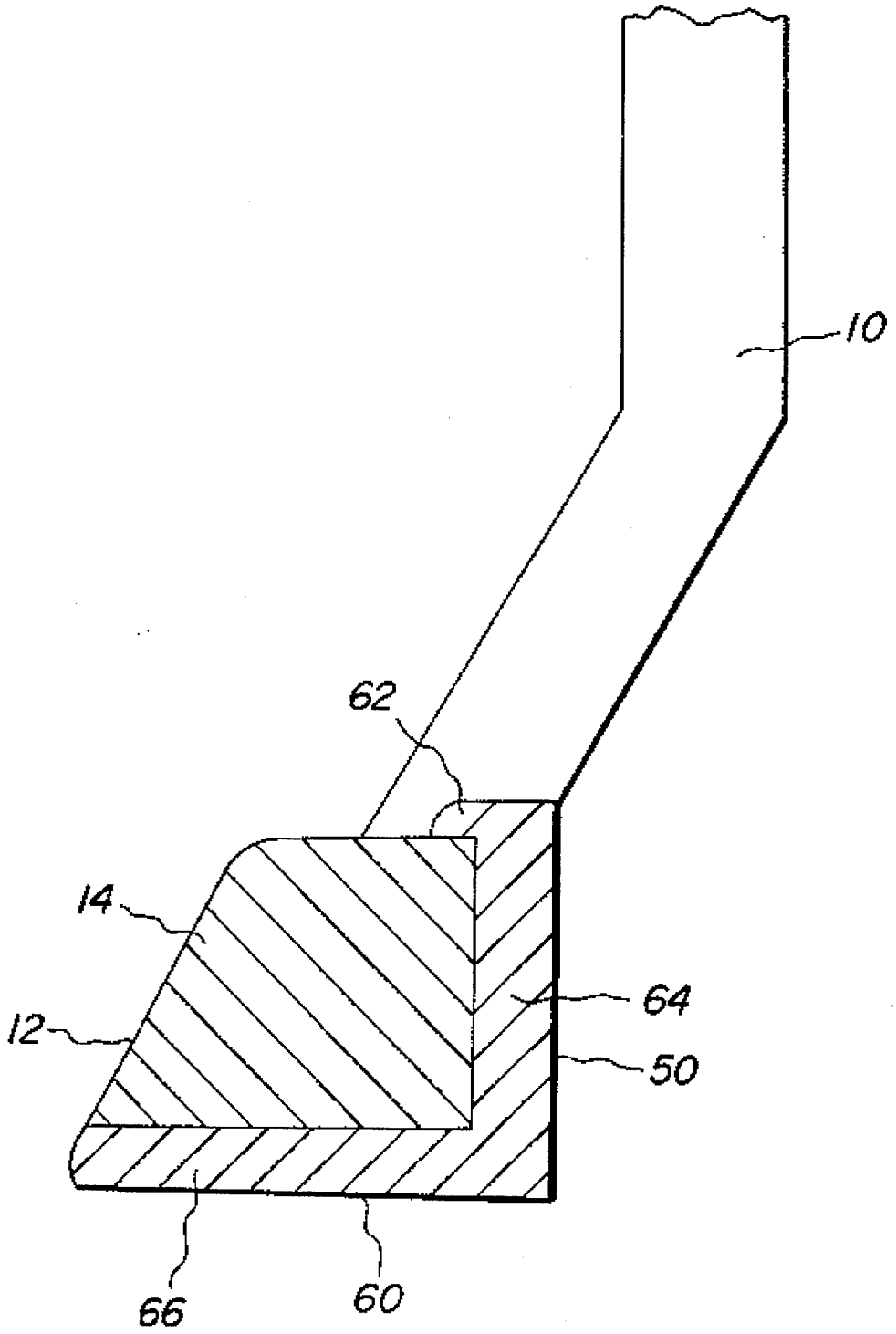
FIG. 9 is a cross-sectional view taken along lines 2—2 of FIG. 1 showing another alternative embodiment of the present invention employing a unitary snap-on elastomeric striking face.

Referring now to FIG. 9, there is shown a further alternative embodiment of the present invention wherein rigid head portion 14 of putter head 12 is adapted by employing a unitary snap-on adaptor 60. Snap-on adaptor 60 includes an upper lip portion 62, a central portion 64 and a lower lip portion 66. Snap-on adaptor 60 is formed from a resilient material which can be deformed in order to snap the snap-on adaptor 60 onto the rigid head portion 14 as shown in the figure. In addition, snap-on adaptor 60 is itself fabricated from an elastomeric material such that it provides an elastomeric striking surface 50 to putter head 12. This embodiment of the present invention provides a simple and efficient device for converting a rigid putter head 12 to a putter head 12 having an elastomeric striking surface 50.

The elastomeric striking surface 50 of the putter of the present invention, whether it be in the form of an elastomeric layer 18, an elastomeric insert 20 or elastomeric strips 22, may be formed from any synthetic or natural elastomeric material such as natural rubber, synthetic rubbers, Surlyn™ or other known elastomeric materials.

The preferred elastomeric striking surface 50 has a durometer hardness which is less than the durometer hardness of a golf ball such that when the elastomeric striking surface 50 is contacted with a golf ball, the elastomeric striking surface 50 will deform rather than the golf ball. It is considered that the elastomeric striking surface 50 provided by the adaptor of the present invention will soften the impact between the putter and golf ball to thereby minimize the distraction for the player at the moment of striking the ball toward the hole. Additional advantages of elastomeric striking surface 50 are mentioned in some of the prior art references cited herein.

A further embodiment of the present invention is a putter which is fitted with any one of the adaptors of the present invention. Such a putter has the advantage that the elastomeric striking face 50 can be removed, if desired, to restore the original putter having a rigid striking face 40. Further, elastomeric striking face 50 can be removed for replacement and/or repair thereby allowing the player to adapt the putter striking surface to differing playing conditions by exchanging the adaptor.

The foregoing detailed description of the invention has been presented for the purposes of illustration and description only and is not to be interpreted as limiting the claims in any way. The scope of the invention is to be determined from the claims appended hereto.

What is claimed is:

1. A golf putter head adaptor for adapting a putter head having a top surface, a bottom surface and a striking surface; to provide the putter head with an elastomeric striking surface, said adaptor comprising:

an attachment layer which includes a central portion adapted to cover at least a substantial portion of the striking surface of a putter head, an upper lip portion adapted to engage the top surface of a putter head and a lower lip portion adapted to engage the bottom surface of a putter head, said attachment layer being provided with an elastomeric insert inserted into the central portion of said attachment layer such that it covers a sufficient portion of the striking surface of the putter head to allow the striking of a golf ball exclusively with said elastomeric insert of the striking surface.

2. A putter head adaptor as claimed in claim 1 which is adapted for a putter head having two striking surfaces, a first striking surface for right-handed putting and a second striking surface for left-handed putting, wherein said attachment layer is further adapted to cover at least a substantial portion of the second striking surface of the putter head and which additionally comprises a second elastomeric insert inserted in said attachment layer such that it covers a sufficient portion of the second striking surface of the putter head to allow the striking of a golf ball exclusively with said second elastomeric insert of the second striking surface.

3. A putter head adaptor as claimed in claim 2 wherein said first and second elastomeric inserts are part of a single, integral elastomeric insert which includes a connecting portion adapted to extend across at least a portion of the bottom surface of the putter head to connect said first and second elastomeric inserts to one another.

4. A putter head adaptor as claimed in claim 1 which is adapted to snap-fit with the putter head.

5. A golf putter comprising a shaft and a putter head having a top surface, a bottom surface and a striking surface, said putter head having an adaptor attached thereto to provide an elastomeric striking surface on said putter head, said adaptor including an attachment layer which includes a central portion adapted to cover at least a substantial portion of the striking surface of said putter head, an upper lip portion adapted to engage the top surface of said putter head and a lower lip portion adapted to engage the bottom surface of said putter head, said attachment layer being provided with an elastomeric insert inserted in the central portion of said attachment layer such that it covers a sufficient portion of the striking surface of said putter head to allow the striking of a golf ball exclusively with said elastomeric insert of the striking surface.

6. A golf putter as claimed in claim 5 which is adapted for a putter head having two striking surfaces, a first striking surface for right-handed putting and a second striking surface for left-handed putting, wherein said attachment layer is further adapted to cover at least a substantial portion of the second striking surface of the putter head and which additionally comprises a second elastomeric insert inserted in said attachment layer such that it covers a sufficient portion of the second striking surface of the putter head to allow the striking of a golf ball exclusively with said second elastomeric insert of the second striking surface.

7. A golf putter as claimed in claim 6 wherein said first and second elastomeric inserts are part of a single, integral elastomeric insert which includes a connecting portion adapted to extend across at least a portion of the bottom surface of said putter head to connect said first and second elastomeric inserts to one another.

8. A golf putter as claimed in claim 5 wherein said putter head adaptor is releasably attached to said putter head.

9. A golf putter as claimed in claim 8 wherein said putter head adaptor is adapted to snap onto said putter head.

10. A snap-on adaptor for adapting a rigid putter head having a top surface, a bottom surface and a striking surface; to provide the putter head with an elastomeric striking surface, said adaptor comprising a central portion adapted to cover at least a substantial portion of the striking surface of a putter head, an upper lip portion adapted to releasably engage the top surface of the putter head and a lower lip portion adapted to releasably engage the bottom surface of the putter head, said central portion being provided with an elastomeric insert inserted in said central portion which covers a sufficient portion of the striking surface of the putter head to allow the striking of a golf ball exclusively with said elastomeric insert of the striking surface.

11. A golf putter head adaptor for adapting a putter head having a top surface, a bottom surface and a striking surface; to provide the putter head with an elastomeric striking surface, said adaptor comprising:

an attachment layer which includes a central portion adapted to cover at least a substantial portion of the striking surface of a putter head, an upper lip portion adapted to engage the top surface of a putter head and a lower lip portion adapted to engage the bottom surface of a putter head, said attachment layer being provided with an elastomeric portion associated with the central portion of said attachment layer such that it covers a sufficient portion of the striking surface of the putter head to allow the striking of a golf ball exclusively with said elastomeric portion of the striking surface and wherein said elastomeric portion comprises a plurality of elastomeric strips affixed to said central portion of the attachment layer.

12. A putter head adaptor as claimed in claim 11 which is adapted for a putter head having two striking surfaces, a first striking surface for right-handed putting and a second striking surface for left-handed putting, wherein said attachment layer is further adapted to cover at least a substantial portion of the second striking surface of the putter head and which additionally comprises a second elastomeric portion associated with said attachment layer such that it covers a sufficient portion of the second striking surface of the putter head to allow the striking of a golf ball exclusively with said second elastomeric portion of the second striking surface.

13. A putter head adaptor as claimed in claim 12 wherein said first and second elastomeric portions are part of a single, integral elastomeric portion which includes a connecting portion adapted to extend across at least a portion of the bottom surface of the putter head to connect said first and second elastomeric portions to one another.

14. A putter head adaptor as claimed in claim 11 which is adapted to snap-fit with the putter head.

15. A golf putter comprising a shaft and a putter head having a top surface, a bottom surface and a striking surface, said putter head having an adaptor attached thereto to provide an elastomeric striking surface on said putter head, said adaptor including an attachment layer which includes a central portion adapted to cover at least a substantial portion of the striking surface of said putter head, an upper lip portion adapted to engage the top surface of said putter head and a lower lip portion adapted to engage the bottom surface of said putter head, said attachment layer being provided with an elastomeric portion associated with the central portion of said attachment layer such that it covers a sufficient portion of the striking surface of said putter head to allow the striking of a golf ball exclusively with said elastomeric portion of the striking surface and wherein said elastomeric portion comprises a plurality of elastomeric strips affixed to said central portion of the attachment layer.

16. A golf putter as claimed in claim 15 which is adapted for a putter head having two striking surfaces, a first striking surface for right-handed putting and a second striking surface for left-handed putting, wherein said attachment layer is further adapted to cover at least a substantial portion of the second striking surface of the putter head and which additionally comprises a second elastomeric portion associated with said attachment layer such that it covers a sufficient portion of the second striking surface of the putter head to allow the striking of a golf ball exclusively with said second elastomeric portion of the second striking surface.

17. A golf putter as claimed in claim 15 wherein said first and second elastomeric portions are part of a single, integral elastomeric portion which includes a connecting portion adapted to extend across at least a portion of the bottom surface of said putter head to connect said first and second elastomeric portions to one another.

18. A golf putter as claimed in claim 15 wherein said putter head adaptor is releasably attached to said putter head.

19. A golf putter as claimed in claim 18 wherein said putter head adaptor is adapted to snap onto said putter head.

* * * * *